US010113843B2

(12) United States Patent
Appleby et al.

(10) Patent No.: US 10,113,843 B2
(45) Date of Patent: Oct. 30, 2018

(54) APPARATUS, SYSTEM AND METHOD FOR INITIATION OF BURIED EXPLOSIVES

(71) Applicant: Orica International Pte Ltd, Singapore (SG)

(72) Inventors: Rodney Appleby, Shailer Park (AU); David Johnson, Aurora, CO (US); Richard Goodridge, Parker, CO (US); Byron Wicks, Alumy Creek (AU)

(73) Assignee: Orica International Pte Ltd, Singapore (SG)

( * ) Notice: Subject to any disclaimer, the term of this patent is extended or adjusted under 35 U.S.C. 154(b) by 0 days.

(21) Appl. No.: 15/129,368

(22) PCT Filed: Mar. 23, 2015

(86) PCT No.: PCT/AU2015/050122

§ 371 (c)(1),
(2) Date: Sep. 26, 2016

(87) PCT Pub. No.: WO2015/143502

PCT Pub. Date: Oct. 1, 2015

(65) Prior Publication Data

US 2017/0074625 A1 Mar. 16, 2017

Related U.S. Application Data

(60) Provisional application No. 61/971,205, filed on Mar. 27, 2014.

(51) Int. Cl.
*F42D 1/05* (2006.01)
*F42B 3/113* (2006.01)
(Continued)

(52) U.S. Cl.
CPC ..... *F42B 3/113* (2013.01); *F42B 3/11* (2013.01); *F42D 1/055* (2013.01)

(58) Field of Classification Search
CPC .. F42B 3/113; F42B 3/11; F42D 1/055; F42D 1/05; F42C 11/065
(Continued)

(56) References Cited

U.S. PATENT DOCUMENTS 4,632,031 A 12/1986 Jarrott
4,685,396 A 8/1987 Birse
(Continued)

FOREIGN PATENT DOCUMENTS

CN 202994000 U 6/2013
PE 10292008 A1 10/2008
(Continued)

OTHER PUBLICATIONS

International Search Report, PCT/AU2015/050122, dated Jun. 3, 2015 (7 pages).
(Continued)

*Primary Examiner* — Michael D David
(74) *Attorney, Agent, or Firm* — Nixon Peabody LLP

(57) ABSTRACT

An initiator apparatus (IA) for blasting, the apparatus including: a magnetic receiver for receiving a magnetic communication signal through the ground by detection of a magnetic field; a controller, in electrical communication with the magnetic receiver, for processing the magnetic communication signal to determine a command for blasting; and a light source in electrical communication with the controller for generating a light beam to initiate a light-sensitive explosive (LSE) in accordance with the command.

30 Claims, 4 Drawing Sheets

(51) Int. Cl.
*F42B 3/11* (2006.01)
*F42D 1/055* (2006.01)

(58) Field of Classification Search
USPC ..... 102/200, 201, 206
See application file for complete search history.

(56) References Cited

U.S. PATENT DOCUMENTS

| | | | | |
|---|---|---|---|---|
| 4,862,802 | A | 9/1989 | Streifer | |
| 7,778,006 | B2 | 8/2010 | Stewart | |
| 2004/0256038 | A1* | 12/2004 | Wood | C06B 27/00 149/19.3 |
| 2008/0156217 | A1 | 7/2008 | Stewart et al. | |
| 2011/0283705 | A1 | 11/2011 | Oliver | |
| 2013/0098257 | A1 | 4/2013 | Goodridge | |
| 2014/0053750 | A1 | 2/2014 | Lownds | |
| 2017/0074630 | A1* | 3/2017 | Kotsonis | F42D 1/05 |
| 2017/0176623 | A1* | 6/2017 | Appleby | G01V 3/104 |

FOREIGN PATENT DOCUMENTS

| | | | |
|---|---|---|---|
| PE | 17792014 | A1 | 11/2014 |
| PE | 22312014 | A1 | 1/2015 |
| RU | 2202097 | C2 | 4/2003 |
| WO | WO 2006/096920 | | 9/2006 |
| WO | WO 2007/124539 | A1 | 11/2007 |
| WO | WO 2008/113108 | A1 | 9/2008 |
| WO | WO 2011/140549 | A2 | 11/2011 |
| WO | WO 2012/061850 | A1 | 5/2012 |
| WO | WO 2012/149584 | A1 | 11/2012 |
| WO | WO 2013/044273 | A1 | 3/2013 |
| WO | WO 2013/082868 | A1 | 6/2013 |
| WO | WO 2013/116938 | A1 | 8/2013 |
| WO | WO 2015/143502 | A1 | 10/2015 |

OTHER PUBLICATIONS

Written Opinion of the International Searching Authority, PCT/AU2015/050122, dated Jun. 3, 2015 (7 pages).

* cited by examiner

APPARATUS, SYSTEM AND METHOD FOR INITIATION OF BURIED EXPLOSIVES

RELATED APPLICATION

The present application claims priority to U.S. Provisional Application No. 61/971,205, filed on 27 Mar. 2014 in the name of Orica International Pte Ltd, and PCT Application No. PCT/AU2015/050122 filed on 23 Mar. 2015, the entire specifications of both are hereby incorporated by reference herein.

TECHNICAL FIELD

The present invention relates generally to apparatuses, primer units, systems and methods for electronic blasting, e.g., systems for initiation of buried explosives in applications including surface mining, underground mining, quarrying, civil construction, and/or seismic exploration on land or in the ocean.

BACKGROUND

In blasting applications, e.g., surface mining, underground mining, quarrying, civil construction, and/or seismic exploration on land or in the ocean, explosives are buried, e.g., in boreholes in selected patterns. To initiate the buried explosives, various initiation apparatuses are used, e.g., detonating cord (also known as "det cord"), or electrically controlled detonators. The timing of the blasts of the explosives in different locations in a blasting pattern can be critical to the success of a blasting operation.

In some environments and complicated applications, it may be undesirable to connect buried explosives with physical connectors, e.g., det cord or electrical cables. For example, such connectors can cause problems if they are strung across a mining site.

Wireless communication with electronic detonators has been proposed, but existing systems remain inappropriate for some applications. For example, some proposed wireless systems using radio-frequency (RF) signals require a line-of-sight connection from a blasting machine to the collar of each borehole. Furthermore, being able to activate electronic detonators with wireless signals may make storing, transporting and deploying such detonators extremely dangerous if blasting signals are received and interpreted at the wrong time, or incorrectly interpreted.

A first class of wireless electronic blasting systems may employ conventional radio wave communications to and from the borehole. In these systems, the receiver or transceiver at each borehole has at least an antenna outside the borehole to communicate, since radio waves may not travel through rock or even through stemming material. A secondary communication channel may be needed between the "top box" and the in-hole device in which the timing is done and which, at the correct time, will cause initiation of the explosives train in the borehole.

A second class of wireless electronic blasting systems may employ through-the-rock wireless communication, in which communication is effected via generation over the blast pattern of a controlled magnetic field that is detected by magnetometers which are part of the initiation devices within each borehole.

Initiation that relies on radio communication to (and optionally from) each borehole has the disadvantage of requiring access by the radio waves to the receiver at the collar of the borehole at blasting time. Since line-of-sight communication is generally much more reliable, it is generally much preferred to reliance on wave reflection or refraction for communication at blasting time. In underground mining in particular, preservation of line-of-sight communication from the firing transmitter to each receiver at the borehole collar is sometimes difficult and may be impossible (for example due to unsafe ground conditions). Through-the-rock communication—which may be referred to as "through-the-earth" (TTE) communication—may be advantageous in allowing blasting to proceed when access to the collars of the holes to be blasted may not be convenient, or safe, or even possible.

The through-rock wireless systems that have been described include a detonator. In these systems, the magnetically-transmitted commands are received by the receiver devices in each borehole. The receiver device then sends an appropriate command to an electric or electronic detonator, which functions as the first element in a conventional explosives train. A disadvantage of this system is inclusion of the detonator which must either be factory or field assembled with the receiver device. Detonators generally contain primary explosives which are more sensitive to electromagnetic interference (EMI), heat, friction, spark and impact, in both manufacture and use, than secondary explosives. For example, a fusehead may pick up an electromagnetic (EM) signal as it generally has poor EM protection, even if electronic portions of a detonator are EM protected. Detonators may require special handling, transportation and storage, which adds to the inconvenience and cost of using detonators as essential components.

Laser initiation systems for blasting may use a laser outside a borehole, and an optical fibre for guiding energy to an explosive in the borehole, or a diode laser included with control electronics connected into the borehole; however, existing laser systems require electrical or optical connections from the initiating device out of the borehole, and are thus prone to failure in some applications, e.g., where the material surrounding the initiating device moves before firing (e.g., due to other earlier blasts in the same area), and may contribute undesirable wire or cable waste in a blasting site.

There is a need, at least in some applications, to simplify electronic blasting systems and to improve their safety.

It is desired to address or ameliorate one or more disadvantages or limitations associated with the prior art, or to at least provide a useful alternative.

SUMMARY

In accordance with the present invention, there is provided an initiator apparatus (IA) for blasting, the apparatus including:

a magnetic receiver for receiving a magnetic communication signal through the ground by detection of a magnetic field;

a controller, in electrical communication with the magnetic receiver, for processing the magnetic communication signal to determine a command for blasting; and a light source in electrical communication with the controller for generating a light beam to initiate a light-sensitive explosive (LSE) in accordance with the command.

The present invention also provides an explosive primer unit including:

the IA described hereinbefore;

an explosive apparatus with LSE coupled to the IA; and a booster explosive around the LSE.

The present invention also provides a blasting system, including:

a plurality of initiator apparatuses, each being the IA described hereinbefore;

a blast controller for generating the command; and a magnetic transmitting system in electrical communication with the blast controller for receiving the command, and configured to generate the magnetic communication signal representing the command.

The present invention also provides a method of blasting, the method including the steps of:

receiving a magnetic communication signal through the ground by detection of a quasi-static magnetic field;

processing the magnetic communication signal to determine a command for blasting; and generating a light beam to initiate a light-sensitive explosive (LSE) in accordance with the command.

The present invention also provides an initiator apparatus (IA) for blasting, the apparatus including:

a magnetic receiver for receiving a magnetic communication signal through the ground by detection of a magnetic field;

a controller, in electrical communication with the magnetic receiver, for processing the magnetic communication signal to determine a command for blasting; and an electro-mechanical interface to control a light source, based on electrical communication from the controller, to generate a light beam to initiate a light-sensitive explosive (LSE) in accordance with the command.

The present invention also provides an initiator apparatus (IA) for blasting, the apparatus including:

a controller component for controlling the IA to follow a command for blasting; and optical coupling for coupling the controller component to an encoder for communicating with the encoder prior to the blasting.

BRIEF DESCRIPTION OF THE DRAWINGS

Preferred embodiments of the present invention are hereinafter described, by way of example only, with reference to the accompanying drawings, in which.

DETAILED DESCRIPTION

Overview

Described herein is a blasting system providing through-rock wireless initiation and in-hole light initiation (or photo-initiation) of a light-sensitive explosive. The described blasting system permits use of initiating apparatuses with electronics packages that contain no explosive, and are thus safer than detonators, and the like, which include explosives. The initiating apparatus need not be manufactured in a licensed explosives factory, and may be manufactured, transported and stored not as hazardous materials but as any other electronic apparatus. There is thus no need to attach long leg wires to the initiating apparatus: adding long leg wires to existing wireless detonators may add to their complexity and cost of manufacture, transport and storage. The described blasting system does not require wired connections from the buried initiating apparatus. The described blasting system does not require access to a collar of a borehole in which the initiating apparatus is buried at blasting time. The initiating apparatus can be controlled to initiate with a programmable timing based on in-hole delay, which can provide a controlled burning front during blasting. The described blasting system may require no detonator and no primary explosive.

Blasting System

Figure 1:
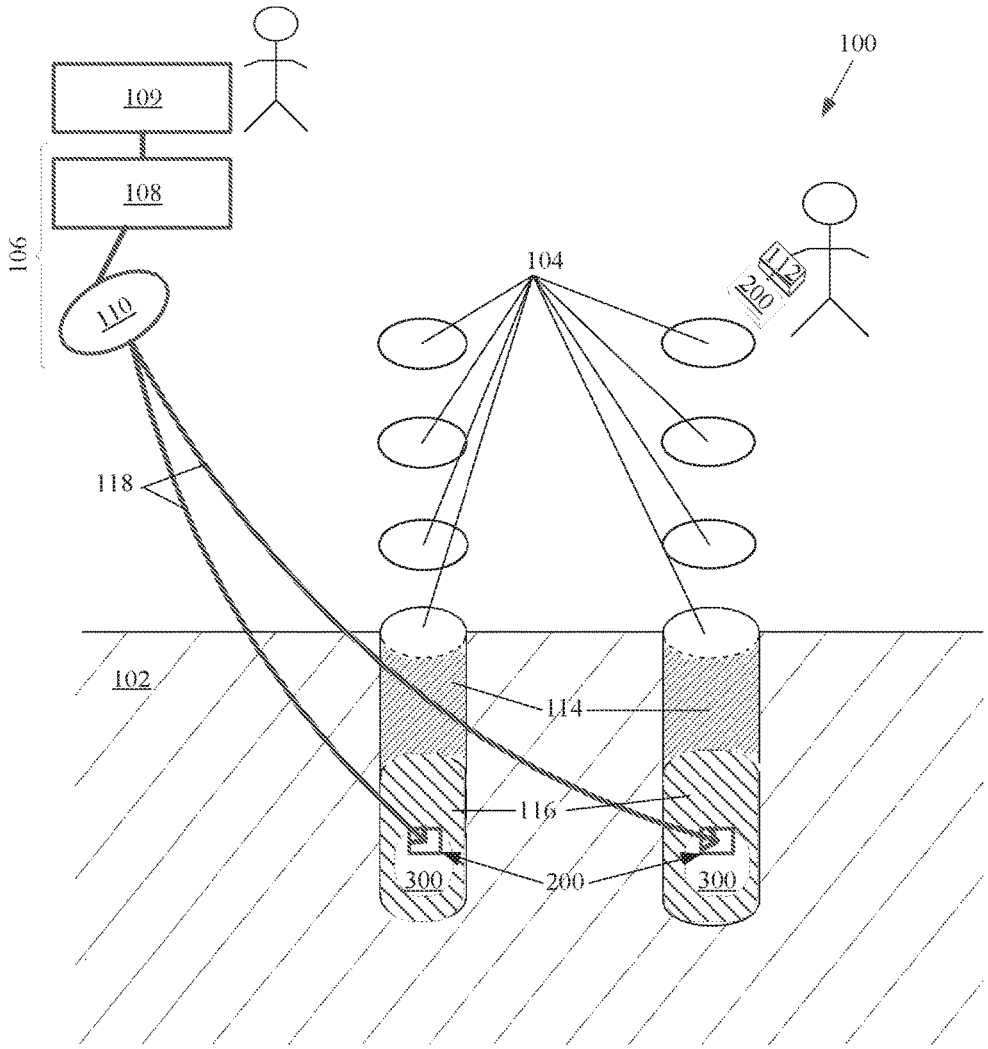
FIG. 1 is a schematic diagram of an embodiment of a blasting system.

A blasting system 100, as shown in FIG. 1, includes a plurality of initiating apparatuses (IAs) 200 (also referred to as "receivers" or "in-hole processing modules") in the ground 102. The ground 102 can include rock and soil etc. Each IA 200 is configured for blasting in a corresponding buried location or "hole" 104 (e.g., a borehole) by placing the IA 200 into a booster to form a primer unit 300 (which may be referred to as a "primer"), and by loading bulk explosive 116 around the primer unit 300 in the hole 104. The hole 104 provides a buried location for the IA 200 to be buried, e.g., in rock, in earth, in building materials, etc. depending on the application site.

The system 100 includes a magnetic transmitting system 106 configured to send signals to the initiating apparatuses 200 through the ground 102. Through-ground wireless communication (which can be referred to as through-the-earth (TTE) communication; or through-rock wireless communication for ground comprising mostly rock) includes communication by wireless signal transmission along wireless through-ground signal paths 118 through the ground 102, through the bulk explosive 116, through the primer unit 300 and into the IA 200.

The through-ground wireless communication is provided by the system 100 between the transmitting system 106 and the initiating apparatuses 200 in their respective holes 104. For example, at the time of firing, the system 100 can provide one-way communication from the transmitting system 106 and each initiating apparatus 200 (or each selected initiating apparatus 200) in its hole 104 to initiate the initiating apparatus 200 and thus a blast.

The system 100 may include an encoder unit 112 (e.g., a hand-held computer equipped with a suitable interface) to program the initiating apparatuses 200 before deployment into the holes 104. Suitable interfaces may include a Universal Serial Bus (USB) cable, RS232 cable, optical coupling, short-range RF coupling, etc.

Transmitting System

The magnetic transmitting system 106 (also referred to as a "transmitter") can include a signal generator 108 that is configured to send a modulated current into a low-resistance conductive loop or coil 110. The coil 110 can include a coil with one or more turns of a conductor capable of carrying a large modulated electrical current, e.g., 50 amps.

The transmitting system 106 is configured to provide a selected transmit range and a selected field strength for magnetic communication signals generated by the transmitting system 106. The transmit range is selected based on application conditions, e.g.: (i) a planned size of a blast using the IAs 200; (ii) a predetermined sensitivity of the IAs 200; and (iii) ambient magnetic noise in an environment in and around the system 100 (i.e., ambient magnetic noise in the micro-Tesla or higher range that would be detected by the IAs 200 in the holes 104). The strength of the magnetic field generated can be controlled based on a diameter and a number of the turns of the coils in the coil 110, and an amplitude of the current flowing through the coils. The number of the turns in the coil of the transmitting coil 110 may be small, and may be one. The current amplitude may be tens to hundreds of amps, e.g., between 10 Amps (A) and 1000 A. The coil diameter may be tens to hundreds of meters e.g., between 10 meters (m) and 1000 m. The coil 110 may comprise a plurality of separate coils supplied from one shared current source and the signal generator 108: in such a multi-coil arrangement, the coils are arranged and configured such that the generated magnetic fields of the coils are additive, while each coil is small enough to be portable by a person, e.g., for placement by a person. The plurality of coils may have diameters between 0.1 m and 10 m.

Frequencies in the modulated electrical current in the coil 110, and thus frequencies in the generated magnetic field, may be in a range from 20 Hertz (Hz) to 2500 Hz.

The signal generator 108 includes one or more electronic modulation components (e.g., circuits, modules, processors, and/or computer-readable memory) configured to modulate signals for transmission by the magnetic field. The electronic modulation components may provide modulation based on Frequency-Shift Keying (FSK), Pulse Width Modulation (PWM), Amplitude Modulation (AM), and/or Frequency Modulation (FM).

The provided modulation is selected based on the type of a magnetic receiver 204 in the IA 200. If the magnetic receiver 204 includes one or more inductive sensors, the modulation includes an alternating current (AC) or oscillating carrier to induce current in the magnetic receiver 204. If the magnetic receiver 204 includes one or more magnetometers, the modulation is quasi-static modulation to allow detection of quasi-static components of the generated magnetic field.

The transmitting system 106 may include an electrical power source including a mains power connection, fuel-powered generators, and/or a supply battery e.g., commercially available generators or arrays of lead-acid batteries.

The transmitting system 106 may include a blast controller 109 (which may be referred to as a "blaster" or "blasting machine") for controlling the signal generator 108. The blast controller 109 may be configured to generate blasting commands for the signal generator 108 to send to the IA 200. The blast controller 109 may include a commercially available computing device (e.g., a personal computer) and blasting software.

The transmitting system 106 may include a user interface (UI) for operation of the system 100. The UI may include a front panel on a box housing the signal generator 108. The UI may include a hand-held device in electronic communication (e.g., using a conductive wire, or optical communications, or short- or long-range radio-frequency transmitters and receivers) with the signal generator 108.

The transmitting system 106 may be placed as close to the blast as is practical to minimise distances through the ground between the transmitting system 106 and the IAs 200. In some embodiments, at close proximity to the blast, the box may be afforded protection, including a protective housing, for example a steel enclosure.

The coil 110 may be made to be disposable, allowing it to be placed very close to, or even amongst or surrounding, the holes 104. The coil 110 may be configured to be disposable by forming the coil 110 using low-cost conductive members, e.g., with insulation designed for a single use. A coil 110 placed very close to the holes 104 may require less transmitting power, and thus less current-carrying capacity, so higher-impedance conductive members could be used in the coil 110. By at least partially destroying or damaging the coil 110 during the blast, e.g., due to heating of the conductive members and/impact from the blasting, the possibility of commands being erroneously transmitted to undesirably unexploded IAs 200 is reduced.

Initiating Apparatus

Figure 2:
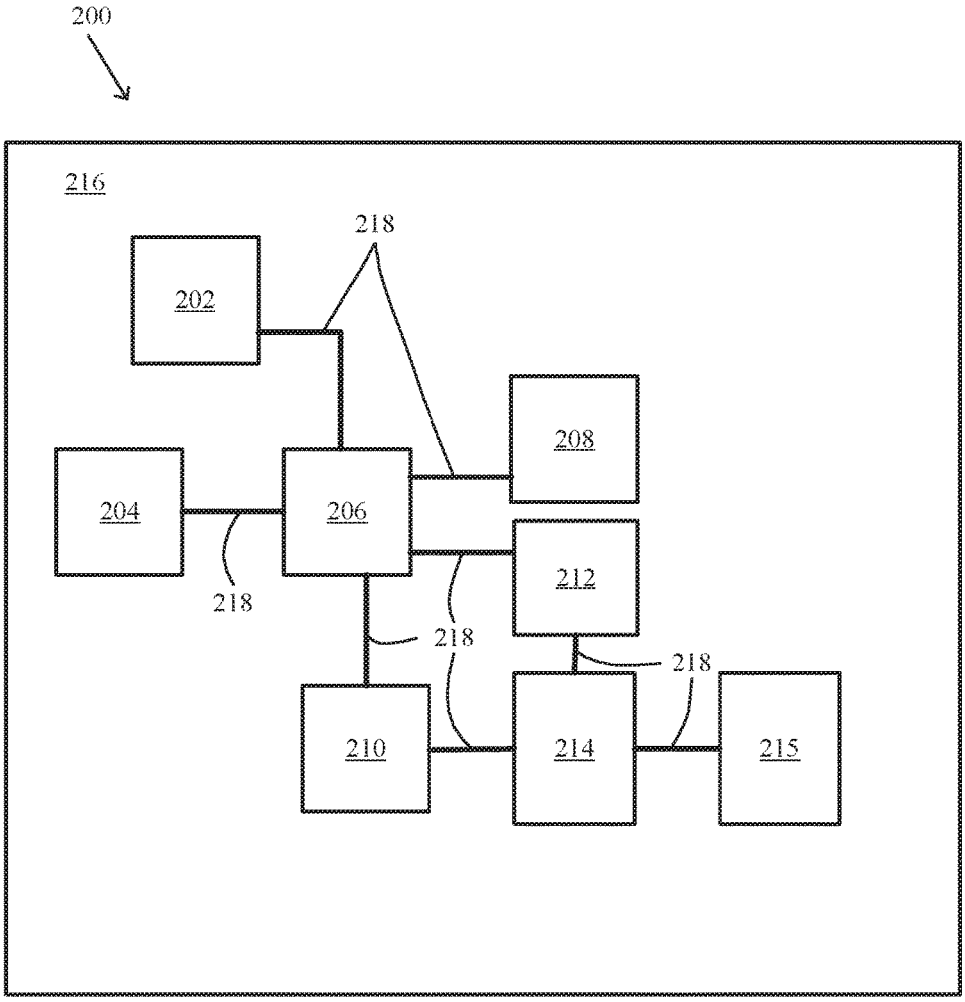
FIG. 2 is a block diagram of an initiation apparatus (IA) in the blasting system.

The initiating apparatus (IA) 200, as shown in FIG. 2, includes a light source 215. The light source 215 can be at one edge or end of the IA 200, thus terminating the IA 200. The light source 215 can include one or more of a light-emitting diode (LED), a laser diode (LD), and camera-flash devices. The light source can be operated in a pulsed mode to produce at least one short pulse of high-intensity light. The reaction time of a target light-sensitive explosive (LSE) may be short, e.g., less than 1 millisecond, and preferably less than 100 microseconds, in order to achieve blast timing selectable to the nearest millisecond. The light source 215 includes a power circuit, that receives power from electronic components of the IA 200. The light source 215 may include optical elements (e.g., a lens, or a lens system) which direct the light pulse to impinge on the LSE with a selected spot size and/or shape. An example light source may be a commercially available laser diode configured to operate when receiving a peak power of 200 W and less than 5 millijoules (mJ) of energy.

The initiating apparatus (IA) 200, as shown in FIG. 2, includes the following electronic components:

- a long-term energy storage component 202 (which may be referred to as an "energy source" for the IA 200), for storing electrical energy, e.g., at least one commercially available battery (e.g., 1.5 V "AAA" batteries each with at least 1 kJ) or long-life capacitor with sufficient capacity to power the light source 215 and the electronic components in the IA 200;
- the magnetic receiver 204 (which may be referred to as a "magnetic receiver component") for detecting transmitted magnetic signals provided by the modulated magnetic field at the location of the magnetic receiver 204 (the transmitted magnetic signals may be referred to as being transmitted "in" the magnetic field);
- an IA controller 206 (which may also be referred to as a controller component, a processor component, or a module), including at least one microprocessor, for demodulating and decoding the detected signals to generate electronic instructions or commands (which may be digital instruction signals);
- a data store 208, which may be referred to as an "information storage component" (e.g., including at least one commercially available electronic data storage device) for electronically (e.g., as digital data) storing at least: a programmable delay time, a code such as group identifier (GID) or individual identifier (IID), etc; electronically (e.g., as digital data);
- a short-term energy storage component 210 (e.g., including a firing capacitor) for receiving (from the energy storage 202) and storing electrical energy in an appropriate form (e.g., at least 5 mJ in a capacitor) to enable rapid discharge to activate the light source 215;
- a timer 212, which may be referred to as a timing component for counting down the delay time (this process is referred to as a "countdown"); and
- a switch 214 for triggering at least one light pulse from the light source 215 when the countdown expires (i.e., ends), by delivery electrical current to the light source 215 to initiate the light-sensitive explosive (LSE).

The switch 214 may be a commercially available switch, e.g., a MOSFET device.

The light source 215 and electronic components 202 to 214 in the IA 200 are electrically connected by electrical conductors 218, e.g., conductive wires or conductive tracks on at least one printed circuit board.

The initiating apparatus 200 may be an integrated device with the components forming a unit inside the housing 216, as shown in FIG. 2. The light source 215 and electronic components 202 to 214 in the IA 200 and the conductors 218 may be mounted on a printed circuit in a housing 216 of the initiating apparatus 200. Alternatively, the components of the initiating apparatus 200 may be formed inside a plurality of separate housings that are connected to communicate electrically with each other. The components 202-215 within the housing 216 or housings may be protected from adverse conditions, especially dynamic shock, by elastic and inelastic components in the housing(s) 216, and sealing structures, e.g., plastic or elastomeric potting material that does not go brittle when subject to mechanical shock, thus protecting the components 202-215 from shock. In embodiments, the housing 216 can be configured so as to be robust enough to withstand environmental conditions, such as, for example, up to about 10 bar of hydrostatic pressure, a watery or fluid or granular explosive medium, high in ammonium nitrate, and sometimes of pH as low as about 2, dynamic shock pressures from the firing of adjacent holes of about 100 to 1000 bar, and sleep times in the hole of the order of months. In embodiments, the housing 216 can be moulded from a polymer (e.g., polypropylene). In some embodiments, the housing 216 may also include metal sleeving (e.g., steel) over some or all of the components for additional strength.

The magnetic receiver 204 includes one or more magnetic field sensors. The magnetic receiver 204 may be a magneto-inductive receiver with one or more magneto-inductive sensors, e.g., commercially available magneto-inductive receivers. The magnetic receiver 204 may be a quasi-static magnetic field sensor, or magnetometer, including one or more magnetometer sensors, e.g. commercially available magneto-resistive devices. The magneto-inductive devices may be coils of fine wire with a ferrite core. Such devices, when customised for the fields being generated (e.g., particular field strengths) may generally be more sensitive than magneto resistive devices. The magnetic receiver 204 may include electronic amplifiers having low noise and very high gain for amplifying electrical signals from the magnetic field sensors, e.g., including commercially available operational amplifiers. The receiver component 204, including the magnetic sensors, the amplifiers and one or more signal processors, can, for example, receive (i.e., detect with an acceptable signal-to-noise ratio) an oscillating magnetic field intensity of the order of about 100 nano-Teslas or less; in embodiments, the range can be about 1 nano-Tesla or less.

The IA controller 206 may be a digital signal processor (DSP) based on a commercially available DSP configured for demodulating and decoding the amplified electrical signal from the magnetic receiver 204. One or more programmable logic controllers (PLCs) or application-specific integrated circuits (ASICs) may be programmed to interpret the incoming signals as commands, and can initiate an appropriate sequence of events for each command. The IA controller 206 may include a state machine with the following statuses: a power-saving mode, an active listening mode, an armed mode, a charging mode, and a firing mode.

The following incoming commands can control the controller component 206 to perform the following tasks:

- a WAKE UP command: wake up from the power-saving mode to the active listening mode;
- a SYNCH command: synchronize a clock in the IA controller 206 to a time in the command;
- a GID command: compare group identities (GIDs) of the command with a stored GID of the IA 200 (e.g., stored in digital memory in the data storage component 208) to determine if they match to arm the IA 200 for further action by moving to the armed mode;
- an IID command or an ARM command: compare a stored individual identity (IID) in the IA 200 with one or more command IDs of the incoming commands, and if they match, arm the IA 200 for further action by moving the state machine into the armed mode;
- a TIME DELAY command: receive, and apply corrections to a delay time in the command for a group of IA's 200 (with a common GID) or an individual IA 200 (based on ID);
- a CHARGE command: generate a firing voltage to charge the short-term store 210 in the charging mode; and
- a FIRE command: control the timer 212 to begin a countdown of the stored delay time in the firing mode, thus leading to firing by discharging the stored energy in the store 210 into the light source 215.

The timer 212 is configured to have a coefficient of variation that is equal to or less than about 0.1%, and preferably equal to less than 0.01%. The timing delay is configured to have a time delay that is selectable with a precision of about 1 ms. The timer 212 may be a commercially available timing component, e.g., a crystal oscillator.

Encoder

The IA 200 may be programmed onsite by the encoder 112. The encoder 112 may be a hand-held device that is easily carried by a user and is suitably rugged for mining conditions. In embodiments, the encoder 112 may send instructions to the controller component 206 without any acknowledge or other back-signal from the controller component 206. In other preferred embodiments, two-way communication can occur between the encoder 112 and the controller component 206. The channel for such communication can be a wire or optical devices connected to the controller component 206 that temporarily connects to the encoder 112, a short range wireless connection such as BlueTooth®, a terminal on the outside of the controller component 206 that mates with a terminal on the encoder 112, or an optical coupling between the controller component 206 and the encoder 112. In order for this optical channel to be established, both the encoder 112 and the controller component 206 can be equipped with a light-emitting diode (LED) and a photocell, e.g., commercially available LED and photocell connected to and controlled by the IA controller 206. In embodiments, the optical channel can avoid having external electrical terminals on the IA 200, which could corrode in a harsh chemical environment, e.g., in mining applications. An example encoder may be based on a commercial hand-held computer (e.g., the Trimble NOMAD™) fitted with an external adapter that contains optical communications equipment, and the hand-held computer provides the user interface.

Encoding of each IA 200 can occur before deployment into the hole 104. Each IA 200 may be uniquely associated with its hole 104, or there may be more than one, sometimes up to ten, IAs 200 per hole 104. The encoder 112 sends to the controller component 206 its delay time (in milliseconds) and optionally its GID, and recovers from the controller component 206 its individual (factory-programmed) ID and optionally a condition report.

Since the IA 200 alone contains no explosive, the operation using the encoder 112 is safe provided that the user can not be subjected to an accidental pulse (or pulses) of light of harmful intensity and/or duration, e.g., if the IA 200 is defective. Having an IA 200 with no explosive allows full-power testing of the IA 200, including measuring the light beam power and/or duration from the light source 215.

Primer Unit

Once encoding is complete with the encoder 112, the IA 200 is coupled, using a coupling, to a booster containing the light-sensitive explosive (e.g., in a capsule) to form the primer unit 300 (which may be referred to as the "primer"). The coupling includes means to keep the surfaces forming the optical interface clean, and provide a seal that is substantially impervious to the environment in the hole (e.g., as a minimum, the seal may withstand hydrostatic pressure of about 10 bar). This primer unit 300 may be deployed into the hole 104. For vertical boreholes, deployment is preferably via a tether so that free-fall of the primer unit 300 is avoided.

Figure 3:
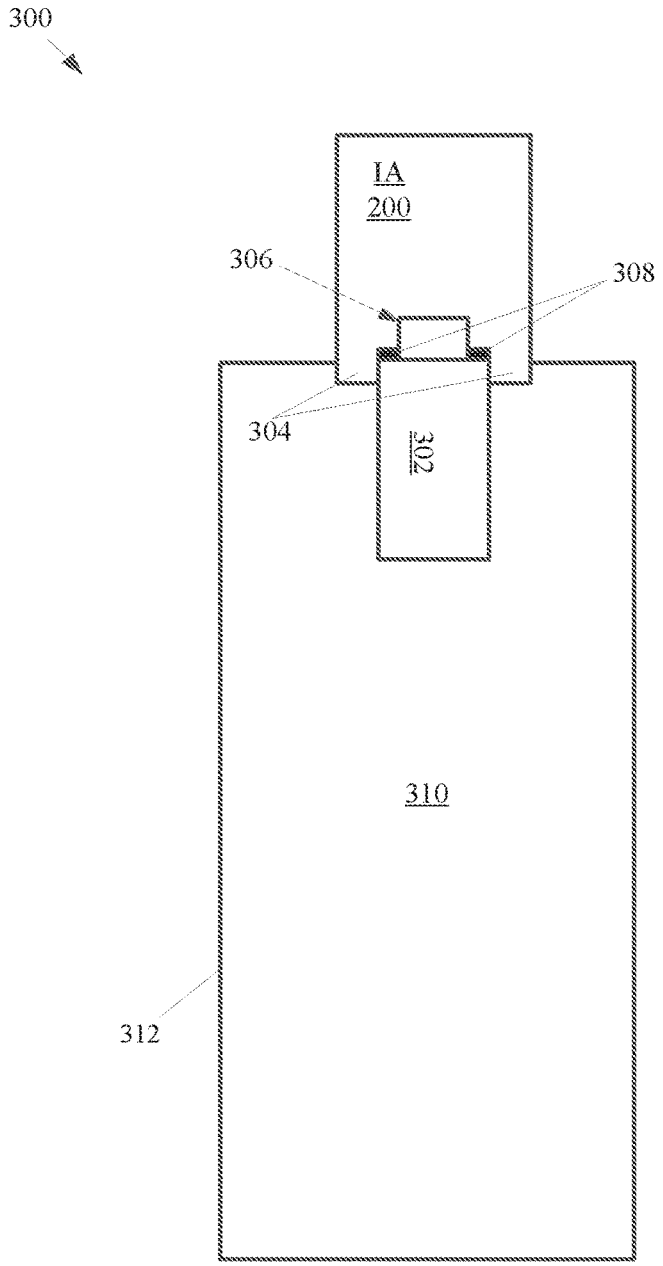
FIG. 3 is a schematic diagram of a primer unit including the IA.

As shown in FIG. 3, the primer unit 300 includes:

- the IA 200;
- an explosive capsule 302 (also referred to as a "match") with the Light-Sensitive Explosive (LSE);
- a connector 304 (e.g., a screw-threaded connector) that provides a mechanical interface for connecting the IA 200 to the capsule 302;
- a sealing window 306 between the light source 215 and LSE;
- a seal 308 between the capsule 302 and the IA 200;
- a booster explosive 310; and
- a primer housing 312 (also referred to as a "case" or "casing").

Example light-sensitive explosives in the capsule 302 may be pentaerythritol tetranitrate (PETN) containing carbon black or another secondary explosives such as Research Department Explosive (RDX) or octagon or High Melting Explosive (HMX). Carbon black may be an effective dopant at a level of 2% to 5% to render the PETN more sensitive to light; the absorption of the visible and infrared light and its conversion to heat ignites the PETN. Detonation may occur via a deflagration-to-detonation transition (DDT), which may proceed more effectively under conditions of strong confinement. The amount and type of light-sensitive explosive initiated is sufficient to initiate an explosives train in a column of commercial explosives, and thus initiate a blast at the location of the initiating apparatus 200. In experiments, the run-up time to full detonation has been found to be less than 100 microseconds without sealing of the distal end of the PETN column.

The capsule 302 may include a hollow confining container, e.g., a short metal tube. The internal diameter of the tube may be in the range of 2 millimeters (mm) to 5 mm, and preferably about 3 mm. The length of the tube is selected based on the explosive that the PETN is required to initiate. For example, the PETN tube can be embedded in a commercial booster, e.g., including Pentolite (Pentolite may include about 40 to 60% TNT, the balance being PETN), and a 50/50 Pentolite blend may be preferred. The length of the pressed PETN column in the tube may be in the range of 10 to 20 mm to adequately initiate the Pentolite that surrounds it intimately.

The surface or volume of the LSE, e.g., at a proximal end of a doped PETN column that is configured to be illuminated by the light source 215, can be sealed for the purpose of efficient DDT by window 306 and seals 308. The window 306 is transparent to the wavelengths of light from the light source 215 e.g., quartz or sapphire can be used for the dual purpose of sealing and allowing the passage of the light pulse. A spherical sapphire lens may be used as a sealing window 306, e.g., with a diameter of about 2.5 mm. The window 306 is preferably extremely strong, resisting the pressure of the DDT event, and has excellent optical properties (e.g., high transmission, low absorption and low distortion of visible and infrared light). The window 306 can be attached in or to the proximal end of the capsule 302 or the IA 200 by providing a precision machined surface of a shape corresponding to the shape of the spherical lens, and optionally providing a thin gasket between the metal tube and the window (e.g., the spherical lens). The window 306 may include an optical lens or lens system, selected for transparency and the wavelengths of the optical source 215, that focuses (or defocuses) the light beam into a selected volume of the LSE (e.g., selected depth and diameter). The window 306 may include two co-operative windows, one in the IA 200 and the other in the capsule 302 that provides the window 306 when the capsule 302 is coupled to an IA 200. The window 306 and the connector 304 and the seal 308 form a coupling for connecting the IA 200 to the capsule 302.

In an embodiment, the light source 215 may not be an integral component of the housing 216, but may be housed within the booster explosive 310, in intimate association with window 306 and capsule 302. In this embodiment, connection of the IA 200 with the booster to form the primer 300 involves forming an electrical rather than an optical connection between the two components of primer 300: i.e., in this embodiment, the IA 200 may include electronic drivers for the light source 215, but not the light source 25 itself, until the IA 200 is assembled to form the primer 300. In this embodiment, IA 200 includes an electro-mechanical interface to control the light source 215, based on electrical communication from the IA controller 206, to generate the light beam to initiate the light-sensitive explosive (LSE) in accordance with command for blasting. The light source 215 and the electronic portions of the IA 200 are electrically and mechanically coupled using the electro-mechanical interface. The electro-mechanical interface includes electrical and mechanical components on the IA 200 that provide equivalent connections to those between the light source 215 and the switch 214. The electro-mechanical interface on the IA 200 may include connectors (electrical pins and plugs, and a bayonet or screw thread), and the light source 215 (in its own housing) may include corresponding connectors (corresponding to the electrical pins and plugs, and a bayonet or screw thread). The electro-mechanical interface for coupling to the light source may include a seal to be dust and/or water resistance, or proof. The seal may be a cover through which the connectors extend.

In seismic exploration applications, the LSE charge may initiate an explosive (e.g., Pentolite) to generate signals (shock waves) for analysis to determine geological characteristics in the search for oil and gas deposits.

In alternative embodiments, the booster may include or be replaced by a detonation cord that can then be connected to other boosters in a conventional manner.

Method of Blasting

Figure 4:
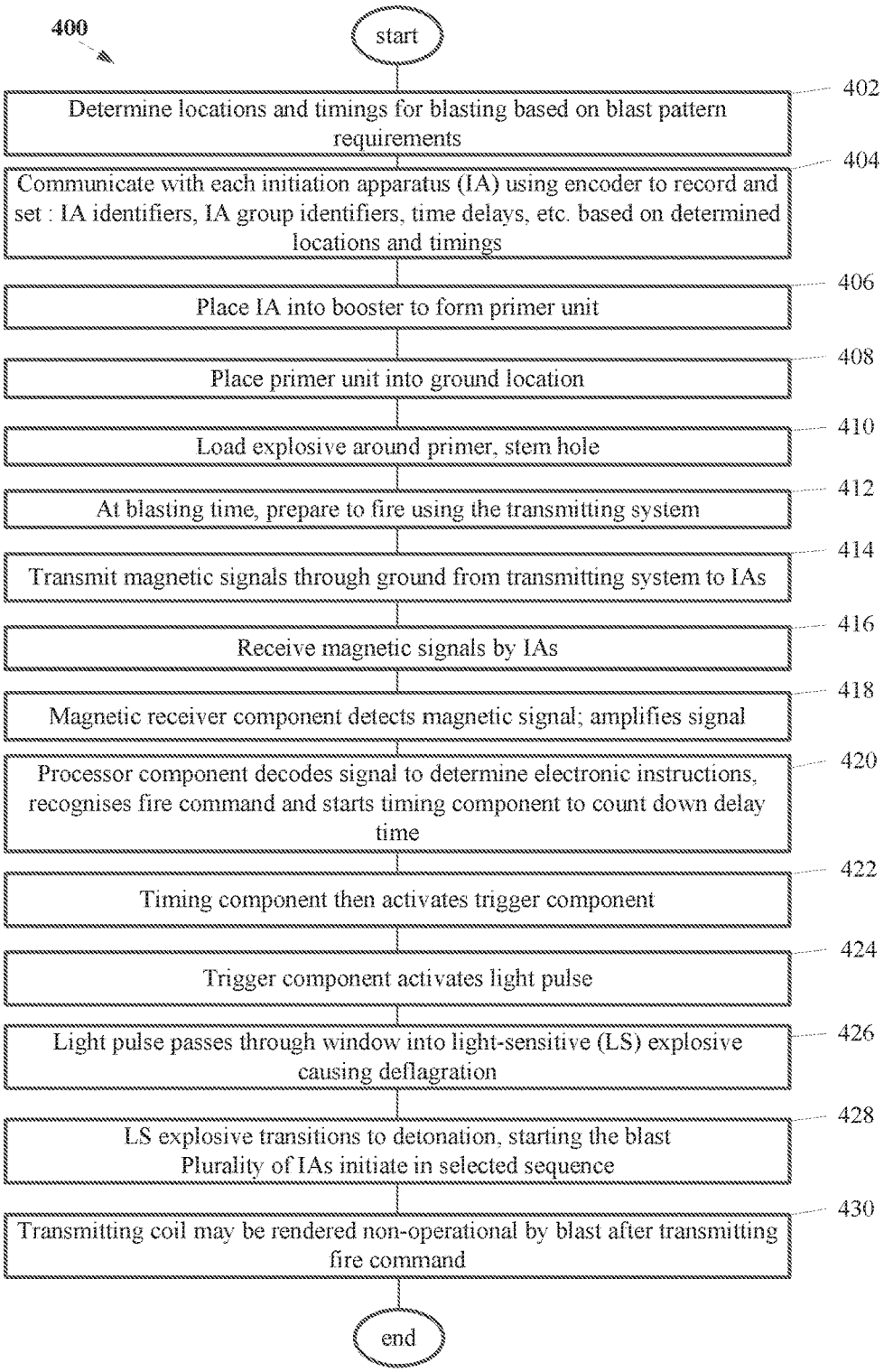
FIG. 4 is a flow chart of a method of blasting using the blasting system.

The system 100 may provide a method 400 of, or for, blasting, including the following steps, as shown in FIG. 4:

- determining locations and timings for blasting based on preselected blast pattern requirements (step 402);
- communicating with each initiation apparatus (IA) 200 using the encoder 112 to record and set: IA individual identities, IA group identities, time delays, etc. based on the determined locations and timings (step 404);
- placing IA 200 into booster to form the primer unit 300 (step 406);
- placing primer 300 into ground location 104 (step 408);

loading explosive 116 around primer 300, stemming hole with stemming material 114 (step 410);

at blasting time, preparing to fire using the transmitting system 106 (step 412);

transmitting magnetic signals through ground 102 from transmitting system 106 to IAs 200 (step 414) including one or more of the commands, e.g., wake-up, synch, time-delay, arm and fire;

receiving magnetic signals by IAs 200 (step 416);

the magnetic receiver 204 detecting the magnetic signal and amplifying the magnetic signal (step 418);

the IA controller 206 decoding signal to determine electronic instructions, recognising fire command, and starting the timer 212 to count down the delay time (step 420);

the timer 212 then activating the switch 214 (step 422);

the switch 214 activating light pulse by discharging the short-term store 210 into the light source 215 (step 424);

the light pulse passing through the window 306 into the LSE causing deflagration (step 426);

the LSE transiting to detonation, starting the blast; and a plurality of IAs may initiate in a selected sequence (step 428); and the transmitting coil 110 may be rendered non-operational by the blast after transmitting fire command (step 430).

Interpretation

Many modifications will be apparent to those skilled in the art without departing from the scope of the present invention.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

The claim defining the invention are as follows:

1. An initiator apparatus (IA) for blasting, the apparatus including:

a magnetic receiver including a magnetometer that receives a magnetic communication signal through the ground by detection of a magnetic field;

a controller, in electrical communication with the magnetic receiver, for processing the magnetic communication signal to determine a command for blasting;

a light source in electrical communication with the controller for generating a light beam to initiate a light-sensitive explosive (LSE) having a reaction time of less than 1 millisecond in accordance with the command; and a data store with a group identifier (GID) code electronically stored, the GID code establishing a group of IAs to which this IA belongs.

2. The IA of claim 1, including a housing around the magnetic receiver, the controller and the light source to provide mechanical protection and for burying the IA.

3. The IA of claim 2, wherein the housing includes a metal sleeve around the magnetic receiver, the controller and the light source.

4. The IA of claim 2, wherein the housing includes potting material around the magnetic receiver, the controller and the light source.

5. The IA of claim 4, wherein the potting material includes plastic potting material and/or elastomeric potting material.

6. The IA of claim 1, including a coupling for connecting the IA to an explosive apparatus.

7. The IA of claim 6, wherein the coupling includes:

a window for transmitting the light beam from the light source to the explosive apparatus;

a connector for mechanically connecting the IA to the explosive apparatus; and a seal for sealing a light path from the light source to the explosive apparatus for the light beam.

8. The IA of claim 6, wherein the explosive apparatus includes the LSE.

9. The IA of claim 6, wherein the explosive apparatus includes an explosive capsule with the LSE.

10. The IA of claim 6, wherein the explosive apparatus is configured for mounting in a booster explosive for detonating a main charge of bulk explosive around the booster explosive.

11. The IA of claim 1, wherein the command is a FIRE command.

12. The IA of claim 1, wherein the command includes a command code and the controller includes instructions that control the controller to: (i) compare the command code with a stored code stored in the IA; and (ii) control the light source to generate the light beam if the command code matches the stored code.

13. The IA of claim 12, wherein the controller is configured to receive the stored code from an encoder unit before the IA is buried.

14. The IA of claim 12, wherein the command code includes a group identifier (GID) code for a group of selected IAs.

15. The IA of claim 1, wherein the magnetic receiver includes a magneto-inductive sensor.

16. The IA of claim 1, wherein the light source includes a light-emitting diode.

17. The IA of claim 1, wherein the light source includes a diode laser.

18. A method of blasting, the method including the steps of:

storing a group identifier (GID) code in an initiator apparatus (IA), wherein the GID establishes a group of IAs to which this IA belongs;

receiving a magnetic communication signal through the ground by detection of a magnetic field by a magnetometer;

processing the magnetic communication signal to determine a command for the IA for blasting; and generating a light beam to initiate a light-sensitive explosive (LSE) having a reaction time of less than 1 millisecond in accordance with the command.

19. An initiator apparatus (IA) for blasting, the apparatus including:

a magnetic receiver including a magnetometer that receives a magnetic communication signal through the ground by detection of a magnetic field;

a controller, in electrical communication with the magnetic receiver, for processing the magnetic communication signal to determine a command for blasting;

an electro-mechanical interface to control a light source, based on electrical communication from the controller, to generate a light beam to initiate a light-sensitive explosive (LSE) having a reaction time of less than 1 millisecond in accordance with the command; and a data store with a group identifier (GID) code stored, the GID code establishing a group of IAs to which this IA belongs.

20. The IA of claim 1, wherein the LSE contains 2% carbon black.

21. The IA of claim 1, wherein the reaction time of the LSE is less than 100 microseconds.

22. A system including the IA of claim 1, and a magnetic transmitting system to send signals to the IA through the ground, wherein the magnetic transmitting system includes a coil that is configured to be disposable.

23. The system of claim 22, wherein a coil diameter of the coil is at least hundreds of meters.

24. The system of claim 22, wherein a current amplitude in the coil is tens of amps.

25. The system of claim 24, wherein the current amplitude is 50 amps.

26. The IA of claim 1, including a connector for connecting the IA to a capsule with the LSE.

27. The IA of claim 26, wherein the connector is a screw-threaded connector or a bayonet connector.

28. An explosive apparatus including the IA of claim 1 and a capsule with the LSE.

29. The explosive apparatus of claim 28, including two co-operative optical windows, one in the IA and the other in the capsule.

30. The system of claim 22, wherein the coil is designed for a single use.

* * * * *